US005115833A

United States Patent [19]

Himle

[11] Patent Number: 5,115,833

[45] Date of Patent: May 26, 1992

[54] GROUND HYDRANT WITH NINETY-DEGREE WATER FLOW TURN-OFF BALL VALVE BELOW FROST LINE

[76] Inventor: Harold Himle, 6362 Chatterleigh Ave., West Valley City, Utah 84120

[21] Appl. No.: 744,303

[22] Filed: Aug. 13, 1991

[51] Int. Cl.[5] ..... E03B 7/12; E03B 9/04

[52] U.S. Cl. ..... 137/286; 137/301; 137/375; 251/287; 251/292; 251/315; 251/316

[58] Field of Search ..... 137/272, 275, 291, 293, 137/294, 295, 301, 302, 315; 251/287, 310, 315, 318, 317, 292; 138/27, 28, 32

[56] References Cited

U.S. PATENT DOCUMENTS

| | | | |
|---|---|---|---|
| 190,868 | 5/1877 | Jarecki | 137/293 |
| 327,822 | 10/1885 | Peter et al. | 137/302 |
| 458,575 | 9/1891 | Hardwick | 137/286 |
| 627,111 | 6/1899 | Graham | 137/286 |
| 750,415 | 1/1904 | Volkhardt | 137/294 |
| 764,864 | 7/1904 | Pollock | 137/286 |
| 785,269 | 3/1905 | Pollock | 137/286 |
| 808,859 | 1/1906 | Mills | 137/286 |
| 915,422 | 3/1909 | Ewart | 137/286 |
| 1,251,306 | 12/1917 | Volkhardt | 137/286 |
| 1,322,014 | 11/1919 | Hanna | 137/375 |
| 1,345,465 | 7/1920 | Snyder | 137/295 |
| 2,650,180 | 8/1953 | Walker | 137/375 |
| 3,066,908 | 12/1962 | Floren et al. | 251/287 |
| 3,244,192 | 4/1966 | Noland | 137/302 |
| 3,407,837 | 10/1968 | Fulton et al. | 137/375 |
| 4,653,521 | 3/1987 | Fillman | 137/1 |
| 4,653,522 | 3/1987 | Fillman et al. | 137/1 |
| 4,756,479 | 7/1988 | Lazenby, III | 239/110 |
| 4,809,949 | 3/1989 | Rakieski | 251/287 |
| 4,852,610 | 8/1989 | McHugh | 251/315 |

*Primary Examiner*—George L. Walton
*Attorney, Agent, or Firm*—John R. Flanagan

[57] ABSTRACT

A ground hydrant includes an elongated hollow water flow pipe positioned from above the ground to below the frost line in the ground, a flow control valve, and a housing which mounts the flow control valve at a position below the frost line in the ground. The flow control valve has a spherical body with an approximately right angle flow bore through it and a hollow extension tube disposed in flow communication with the flow bore and projecting outwardly from the body and coupled in flow communication with the lower end of the flow pipe. The housing mounts the flow control valve extension tube and spherical body for rotation about the longitudinal axis of the flow pipe between opened and closed positions in which flow communication is respectively permitted and prevented from a pressurized supply of water to the flow tube via the flow bore and extension tube. The flow control valve is rotatable between the opened and closed positions by rotating the flow pipe about its longitudinal axis. The flow pipe can be unthreaded from or threaded with the extension tube of the flow control valve when the control valve is at its closed position. The hydrant also has a support pipe disposed around and spaced sufficiently outwardly from the water flow pipe to permit insertion of a heat tape between them.

18 Claims, 2 Drawing Sheets

GROUND HYDRANT WITH NINETY-DEGREE WATER FLOW TURN-OFF BALL VALVE BELOW FROST LINE

BACKGROUND OF THE INVENTION

1. Field of the Invention

The present invention generally relates to ground hydrant construction and, more particularly, is concerned with a ground hydrant having a right angle water flow turn-off ball valve below the frost line in the ground.

2. Description of the Prior Art

A conventional ground hydrant typically has a vertical water flow pipe extending from above the ground downwardly into the ground to the location of an underground pressurized water supply line below the frost line. The hydrant employs an operating lever handle and a outlet nozzle on the upper end of the flow pipe, a straight-through water flow ball valve assembly below the frost line and operable for connecting in flow communication a right angle elbow on the lower end of the flow pipe with the pressurized water supply line, and a rod extending between the ball valve assembly and operating lever for actuating the ball valve assembly between opened and closed positions by moving the lever handle.

To prevent freezing of water in the upper portion of the vertical water flow pipe, conventional ground hydrants typically incorporate a drain hole in the lower end of the flow pipe to permit the residual water within the flow pipe to drain from the flow pipe below the frost line during periods of nonuse. A serious drawback of this way of draining the flow pipe is that the drain hole also provides a major avenue for foreign matter to enter the flow pipe and contaminate to the water being discharged at the outlet nozzle of the hydrant.

To avoid this drawback of conventional ground hydrants, alternative ground hydrant constructions have been proposed in U.S. Pat. No. 4,653,521 to Fillman and U.S. Pat. No. 4,653,522 to Fillman et al which eliminates the use of a bottom drain hole that drains off residual water to the surrounding ground. Instead, a drain water collection system is employed which acts as a reservoir for the drain water and is connected by a drain line to a discharge location above the ground. The drain water collection system is operated by the same lever handle that operates the hydrant.

While the alternative ground hydrant constructions of the cited patents may reduce the potential for water contamination through the drain hole, they introduce a new set of problems. These problems are increased costs and reduced reliability due to the introduction of the more complicated system of mechanical components used in the alternative constructions. These problems make it unlikely that the proposed alternative constructions could provide commercially viable solutions.

Consequently, a need still exists for improvement in ground hydrant construction which will overcome the potential contamination problem of the conventional design without introducing a new set of problems.

SUMMARY OF THE INVENTION

The present invention provides a ground hydrant designed to satisfy the aforementioned needs. The ground hydrant of the present invention eliminates the possibility of contamination by avoiding use of a drain hole in the bottom of the hydrant. The ground hydrant has a simple construction which improves reliability and simplifies maintenance. Also, the water flow pipe of the ground hydrant is easy to remove and replace should it become damaged by weather-related or accidental causes.

Accordingly, the present invention is directed to a ground hydrant which comprises: (a) an elongated hollow water flow pipe for positioning from above the ground to below the frost line in the ground, the flow pipe having a longitudinal axis; (b) a flow control valve having a body with a substantially right angle flow bore through it and a hollow extension tube disposed in flow communication with the flow bore and projecting outwardly from the body; (c) means for coupling the flow pipe to the extension tube to establish flow communication between the flow pipe and extension tube; and (d) a housing for positioning below the frost line in the ground, the housing mounting the extension tube and body of the control valve for rotational movement about an axis extending coaxially with the longitudinal axis of the flow pipe and between opened and closed positions in which flow communication is respectively permitted and prevented from a pressurized supply of water to the flow tube via the flow bore and extension tube. The control valve is rotatable between the opened and closed positions by rotating the flow pipe about its longitudinal axis. The coupling means is operable to permit attaching and detaching of the flow pipe to and from the extension tube of the control valve when the control valve is in its closed position.

The ground hydrant also includes an elongated support pipe. The support pipe is disposed around the water flow pipe such that the support pipe concentrically surrounds the flow pipe and is spaced outwardly therefrom. The space between the outer support pipe and inner water flow pipe is sufficient to permit insertion of a heat tape between them.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
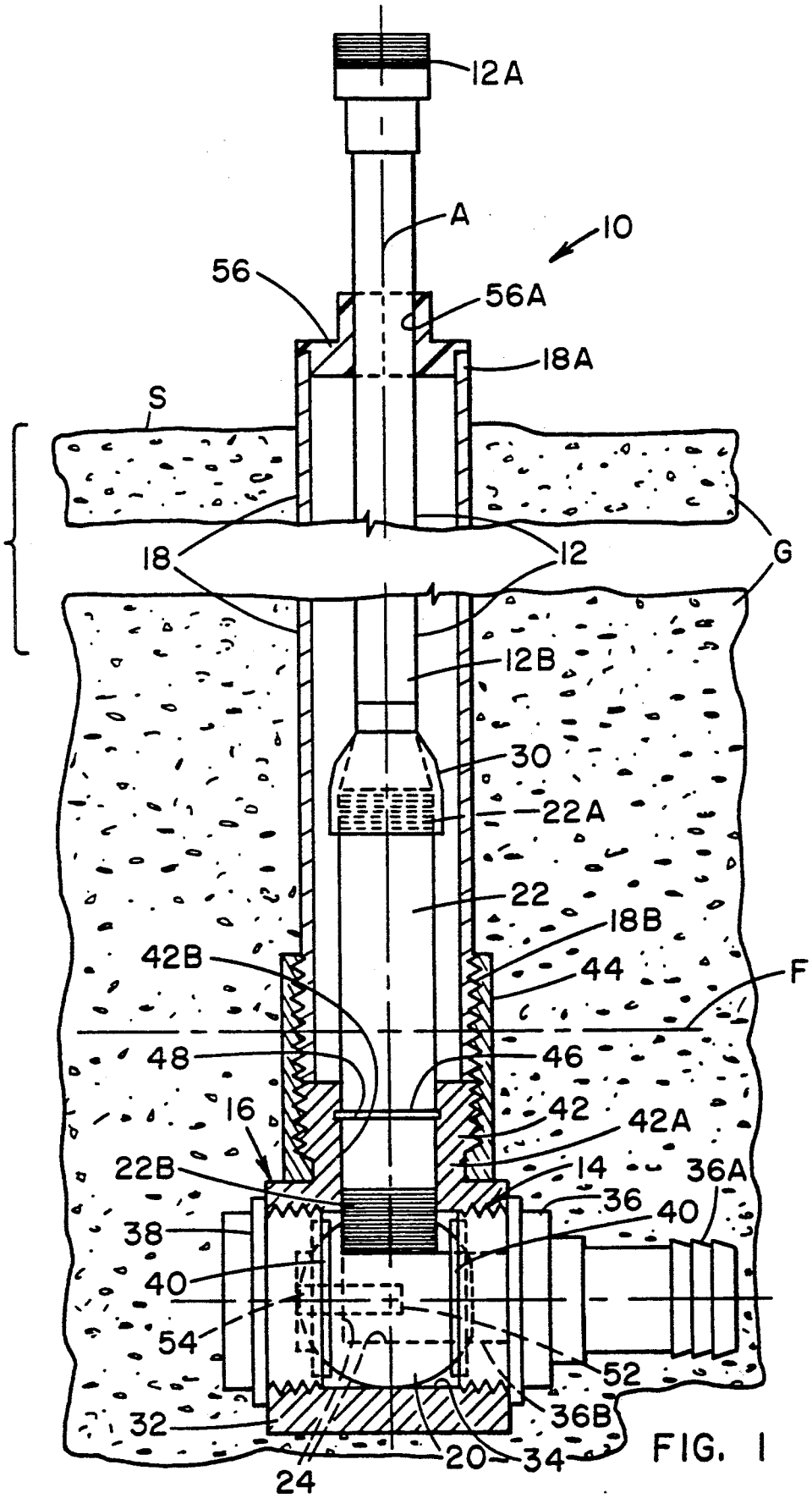
FIG. 1 is a longitudinal axial sectional view of a ground hydrant of the present invention.

In the following description, like reference characters designate like or corresponding parts throughout the several views of the drawings. Also in the following description, such terms as "top", "bottom", "front", "rear" and the like, are words of convenience and are not to be construed as limiting terms.

Referring to the drawings, and particularly to FIG. 1, there is illustrated a ground hydrant, generally designated 10, of the present invention for use in a variety of applications, for example but not limited to, residential yards, recreational parks, mobile home parks and trailer parks. In its basic components, the ground hydrant 10 includes an elongated inner hollow water flow stem or pipe 12, a water flow control valve 14, and a valve housing 16. The ground hydrant 10 also preferably includes an elongated outer support pipe 18.

The inner water flow pipe 12 of the hydrant 10, when installed as seen in FIG. 1, is positioned from above surface level S of the ground G to below the frost line F in the ground. The outer support pipe 18 is disposed in the ground G around the inner flow pipe 12 such that the outer support pipe 18 concentrically surrounds the inner flow pipe 12 and is spaced outwardly therefrom. The empty space between the outer support pipe 18 and the inner water flow pipe 12 is sufficient in size to permit the insertion of a heat tape or similar device between them for use when the air and ground are at subfreezing temperatures to prevent freezing of water in the flow pipe 12. An upper end 12A of the flow pipe 12 is externally-threaded for facilitating attachment to it of a conventional shutoff valve and discharge nozzle assembly (not shown). A lower end 18B of the outer support pipe 18 is externally-threaded for facilitating its attachment to the valve housing 16.

Figure 3:
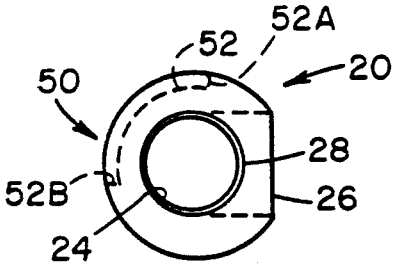
FIG. 3 is a top plan view of the flow control valve body as seen along line 3—3 of FIG. 2.
Figure 5:
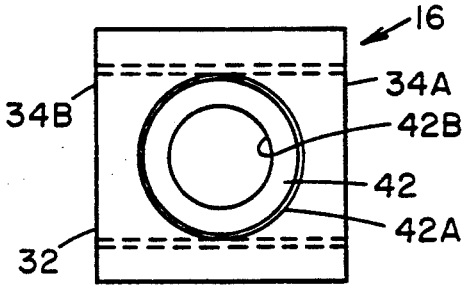
FIG. 5 is a top plan view of the control valve housing as seen along line 5—5 of FIG. 4.
Figure 2:
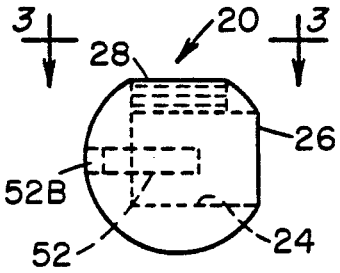
FIG. 2 is a side elevational view of a flow control valve body of the ground hydrant of FIG. 1.
Figure 4:
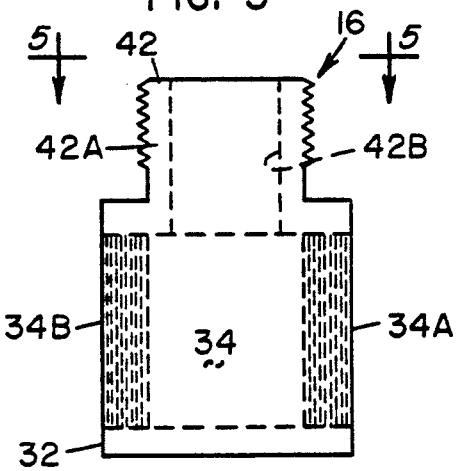
FIG. 4 is a side elevational view of a control valve housing of the ground hydrant of FIG. 1.

Referring to FIGS. 1-3, the water flow control valve 14 of the ground hydrant 10 positioned below the frost line F in the ground is capable of providing flow communication between an underground supply of pressurized water (not shown) and a lower end 12B of the inner water flow pipe 12. The flow control valve 14 includes a generally round or ball-like body 20, preferably having a spherical configuration, and a hollow nipple or extension tube 22 attached to it. The valve body 20 has a generally right angle flow bore 24 defined through it and an inlet orifice 26 and an outlet orifice 28 defined at opposite ends of the right angle flow bore 24. The outlet orifice 28 is internally threaded. The hollow extension tube 22 has a lower end 22B externally threaded for attachment to the internally-threaded outlet orifice 28 of the valve body flow bore 24. In such manner, the hollow extension tube 22 is disposed in flow communication with the flow bore 24 of the valve body 20 and projects upwardly from the body to where it couples with the lower end 12B of the inner flow pipe 12.

An annular adapter or coupler 30 is attached on the lower end 12B of the inner flow pipe 12. The coupler 30 is internally threaded to facilitate its attachment over the externally-threaded upper end 22A of the extension tube 22. The coupler 30 connects the inner flow pipe 12 to the extension tube 22 so as to establish flow communication between them. The threaded connection between the coupler 30 and threaded upper end 22A of the extension tube 22 is operable to permit attaching and detaching of the flow pipe 12 to and from the extension tube 22 and thereby to and from the control valve 14.

Referring again to FIG. 1, the valve housing 16 of the hydrant 10 is also positioned underground below the frost line F. The valve housing 16 mounts the valve body 20 and extension tube 22 for rotational movement about the the longitudinal axis A of the inner flow pipe 12 in order to dispose the valve body 20 at either opened or closed positions relative to the valve housing 16.

More particularly, referring to FIGS. 4-9, the valve housing 16 includes a housing block 32 having a pair of opposite, circular-shaped axially-aligned internally-threaded openings 34A, 34B and an elongated cylindrical cavity 34 extending through the housing block between the opposite openings 34A, 34B. The housing 16 also includes an externally-threaded circular-shaped inlet port member 36 threaded into the one opening 34A of the housing block 32 and an externally-threaded circular-shaped stopper member 38 threaded into the opposite opening 34B of the housing block 32. The spherical valve body 20 is disposed in the cylindrical cavity 34 and the inlet port member 36 and stopper member 38 have respective opposite sides of annular seats 40 which sealingly engage the valve body 20.

The inlet port member 36 which constitutes the inlet end of the valve housing 16 has a connector portion 36A connectable with the supply line (not shown) providing the source of pressurized water, and a passageway 36B which extends in flow communication with the inlet orifice 26 of the flow bore 24 of the valve body 20 when the body is at the opened position. The passageway 36B provides communication of the pressurized water to the flow bore 24. The valve housing block 32 also includes an outlet port member 42 which constitutes the outlet end of the valve housing 16. The outlet port member 42 is integrally attached to the valve housing block 32 and has a connector portion 42A being externally-threaded and interconnectable via an internally-threaded sleeve 44 to the externally-threaded lower end 18B of the outer support pipe 18. The outlet port member 42 also includes a passageway 42B which receives the extension tube 22. An 0-ring seal 46 is installed in an annular groove 48 in the cylindrical wall of the outlet port member 42 defining the passageway 42B for providing a seal between the extension tube 22 and the valve housing 16. The passageway 42B provides flow communication between the flow bore outlet orifice 28 and the inner flow pipe 12.

The cavity 34 in the valve housing block 32 mounts the control valve body 20 for movement between the opened and closed positions about the longitudinal axis A of the flow pipe 12. As seen in FIG. 1, the circular inlet orifice 26 of the valve body 20 when at the opened position is aligned with the passageway 36B of the inlet port member 36 of the valve housing 16 so as to permit communication of pressurized water from the supply thereof to the flow bore 24. On the other hand, the inlet orifice 26 of the valve body 20 when at the closed position is offset from the passageway 36B of the inlet portion member 36 of the valve housing 16 so as to block communication of pressurized water from the supply thereof to the flow bore 24.

The stopper member 38 is disposed in the valve housing block 32 adjacent the valve body 20 and closes the one opening 34A of the housing block 32. The stopper member 38 thereby defines a closed side of the cavity 34. Both the valve body 20 and the stopper member 38 have complementary interengaging means 50 defined thereon for limiting the amount of rotational movement of the valve body 20 relative to the valve housing 16 to that distance between the opened and closed positions of the control valve 14. The interengaging means 50 includes an elongated slot 52 recessed in the exterior surface of the valve body 20 adjacent to the stopper member 38 and defining an arc of approximately 110° about the rotational axis A of the valve body 20. The arcuate slot 52 has stop surfaces 52A, 52B defined at opposite ends of the slot. A stop pin 54 is attached to the stopper member 38 and projects into the slot 52 of the valve body 20. The stop pin 54 is engageable with the respective slot end stop surfaces 52A, 52B as the valve body 20 is rotated, by turning the flow pipe 12, to the respective opened and closed positions relative to the valve housing 16.

In summary, in its opened position, the water flow control valve 14 provides flow communication from the pressurized supply of water to the inner flow tube 12 via the hollow extension tube 22, the right angle flow bore 24 in the valve body 20 and the passageways 36B, 42B of the inlet and outlet port members 36, 42 of the valve housing 16. The valve body 20 is shown in its opened position in FIG. 1. The closed position of the flow control valve 14 is reached by rotation of the valve body 20 approximately 90° counterclockwise (as viewed from above the valve body) about the longitudinal axis A of the flow pipe 12. The control valve 14 is rotated about the longitudinal axis A of the flow pipe 12 between the opened and closed positions by rotating the flow pipe 12 about its longitudinal axis A from above the ground S. Also, the threaded connection between the coupler 30 and the threaded upper end 22A of the extension tube 22 of the control valve 14 permits threading, or attaching, and unthreading, or detaching, of the flow pipe 12 to and from the extension tube 22 and thereby to and from the control valve 14 once the control valve body 20 has been rotated to its closed position.

Figure 11:
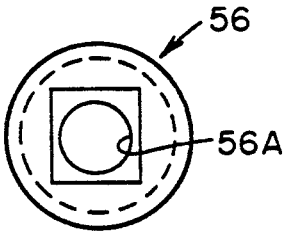
FIG. 11 is a top plan view of the end cap member as seen along line 11—11 of FIG. 10.
Figure 10:
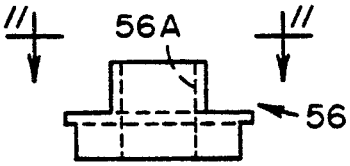
FIG. 10 is a side elevational view of an end cap member of the ground hydrant of FIG. 1.
Figure 6:
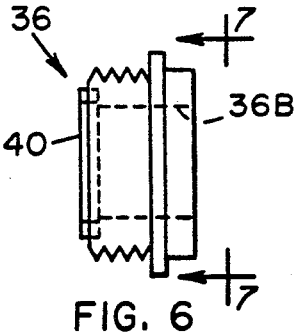
FIG. 6 is a side elevational view of an inlet port member of the ground hydrant of FIG. 1.
Figure 7:
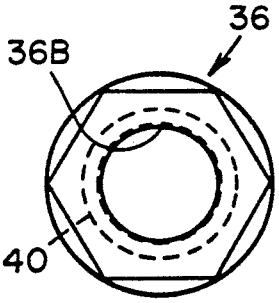
FIG. 7 is an end elevational view of the inlet port member as seen along line 7—7 of FIG. 6.
Figure 9:
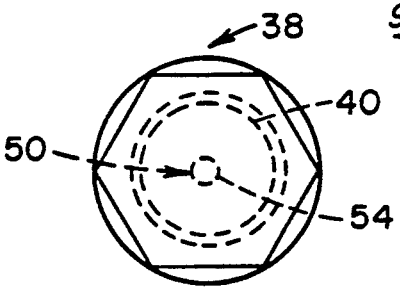
FIG. 9 is an end elevational view of the stopper member as seen along line 9—9 of FIG. 8.
Figure 8:
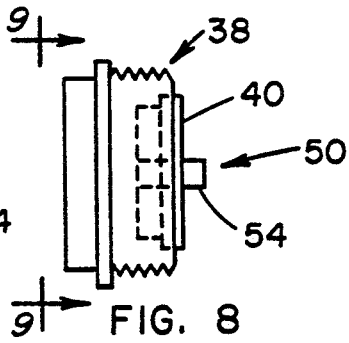
FIG. 8 is a side elevational view of a stopper member of the ground hydrant of FIG. 1.

Referring to FIGS. 1, 10 and 11, an annular cap 56 is disposed in a sealing relation within an open upper end 18B of the outer support pipe 18. The annular cap 56 has a central opening 56A through which the inner flow pipe 12 extends and by which it is laterally supported in a sliding sealing relation with the cap. The cap 56 thus laterally supports the inner flow pipe 12 while at the same time permits rotational and axial movement of the flow pipe 12 relative thereto. Once the flow pipe 12 has been unthreaded from the extension tube 22 of the valve 14, it can be easily withdrawn upwardly thought the cap 56 for repair and/or replacement purposes.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. A ground hydrant, comprising:

(a) an elongated hollow water flow pipe for positioning from above the ground to below the frost line in the ground, said flow pipe having a longitudinal axis;

(b) a flow control valve having a generally spherical body with a generally right angle flow bore defined through it and a hollow extension tube disposed in flow communication with said flow bore and projecting outwardly from the body;

(c) means for coupling the flow pipe to said extension tube to establish flow communication between said flow pipe and said extension tube; and (d) a valve housing for positioning below the frost line in the ground, said housing mounting said extension tube and said spherical body of said control valve for rotational movement about said longitudinal axis of said flow pipe and between opened and closed positions in which flow communication is respectively permitted and prevented from a pressurized supply of water to said flow tube via said flow bore and extension tube, said control valve being rotatable between said opened and closed positions by rotating said flow pipe about said longitudinal axis thereof;

(e) said valve housing including a housing block having a pair of opposite circular-shaped axially-aligned openings and an elongated cylindrical cavity extending through said housing block between opposite openings, said spherical body of said control valve being disposed in said cylindrical cavity of said housing block;

(f) said valve housing also including a circular-shaped stopper member extending into and attached within one of said opposite openings of said housing block so as to close said one opening and a circular-shaped inlet port member extending into and attached within the other of said opposite openings of said housing block so as to close said other opening, said stopper member and said inlet port member defining respective seats disposed within said cylindrical cavity in spaced apart facing relation to one another and sealingly engaging opposite sides of said spherical body of said control valve and disposing said spherical body in alignment therewith, and said stopper member defining means for limiting rotation of said spherical body between said opened and closed positions about an axis extending coaxial with said longitudinal axis of said flow pipe.

2. The ground hydrant of claim 1 wherein:

said valve body has an inlet orifice and an outlet orifice; and said extension tube has opposite ends, said extension tube being attached to one of said opposite ends to said body at said outlet orifice thereof in flow communication with said right angle flow bore.

3. The ground hydrant of claim 1 said means for coupling said flow pipe to said extension tube includes respective threaded portions on said flow pipe and said extension tube being operable to permit attaching and detaching of said flow pipe to and from said extension tube of said control valve when said control valve is in its closed position.

4. The ground hydrant of claim 1 wherein said valve housing includes:

an inlet end defined by said inlet port member being connectable with the supply of pressurized water; and an outlet end receiving and rotatably mounting said extension tube.

5. The ground hydrant of claim 4 wherein said valve body includes an inlet orifice and an outlet orifice defined at opposite ends of said right angle flow bore of said valve body, said inlet orifice of said valve body when at said opened position being aligned with said inlet end of said valve housing so as to permit communication of pressurized water from the supply thereof to said flow bore, said inlet orifice of said valve body when at said closed position being offset from said inlet end of said valve housing so as to block communication of pressurized water from the supply thereof to said flow bore.

6. The ground hydrant of claim 1 wherein said rotation limiting means includes:

interengaging means defined on said spherical body of said control valve and said seat of said stopper member for limiting rotational movement of said valve body relative to said valve housing to between said opened and closed positions, said interengaging means including an elongated slot recessed in an exterior surface of said valve body adjacent to said stopper member and defined in an arc about said rotational axis of said valve body, said slot having stop surfaces defined at opposite ends of said slot, said interengaging means further including a stop pin attached to said stopper member and projecting into said slot, said stop pin being engageable with said respective slot end stop surfaces as said valve body is rotated to said respective opened and closed positions relative to said valve housing.

7. The ground hydrant of claim 1 further comprising:

an elongated support pipe for positioning around said flow pipe and attaching to said valve housing.

8. The ground hydrant of claim 7 wherein said support pipe is spaced sufficiently outwardly from said flow pipe to permit insertion of a heat conducting device between said flow pipe and said support pipe.

9. The ground hydrant of claim 7 further comprising:

an annular cap disposed in a sealing relation on an open end of said support pipe and having a central opening with said flow pipe extending therethrough in a sealing relation with said cap while permitting rotational and axial movement of said flow pipe relative thereto.

10. A ground hydrant, comprising:

(a) an elongated hollow water flow pipe for positioning from above the ground to below the frost line in the ground, said flow pipe having a longitudinal axis;

(b) an elongated support pipe for positioning around said flow pipe and attaching to said valve housing;

(c) a flow control valve having a generally spherical body with a generally right angle flow bore defined through it and a hollow extension tube disposed in flow communication with said flow bore and projecting outwardly from said body;

(d) means for coupling the flow pipe to said extension tube to establish flow communication between said flow pipe and said extension tube; and (e) a valve housing for positioning below the frost line in the ground, said valve housing mounting said extension tube and said spherical body of said control valve for rotational movement about said longitudinal axis of said flow pipe and between opened and closed positions in which flow communication is respectively permitted and prevented from a pressurized supply of water to said flow tube via said flow bore and extension tube, said control valve being rotatable between said opened and closed positions by rotating said flow pipe about said longitudinal axis thereof, said coupling means being operable to permit attaching and detaching of said flow pipe to and from said extension tube of said control valve when said control valve is in its closed position;

(f) said valve housing including a housing block having a pair of opposite circular-shaped axially-aligned openings and a cylindrical cavity extending through said housing block between opposite openings, said spherical body of said control valve being disposed in said cylindrical cavity of said housing block;

(g) said valve housing also including a circular-shaped stopper member extending into and attached within one of said opposite openings of said housing block so as to close said one opening and a circular-shaped inlet port member extending into and attached within the other of said opposite openings of said housing block so as to close said other opening, said stopper member and said inlet port member defining respective seats disposed within said cylindrical cavity in spaced apart facing relation to one another and sealingly engaging opposite sides of said spherical body of said control valve and disposing said spherical body in alignment therewith, and said stopper member defining means for limiting rotation of said spherical body between said opened and closed positions about an axis extending coaxial with said longitudinal axis of said flow pipe.

11. The ground hydrant of claim 10 wherein:

said valve body has a threaded outlet orifice; and said extension tube has opposite ends, said extension tube being threadably attached at one of said opposite ends to said body at said outlet orifice thereof in flow communication with said right angle flow bore.

12. The ground hydrant of claim 10 wherein said valve housing includes:

an inlet end defined by said inlet port member and having a portion connectable with the supply of pressurized water and a passageway extending in flow communication with said flow bore of said valve body when said body is at said opened position for flowing pressurized water to said flow bore; and an outlet end having a portion connectable to an end of said support pipe and a passageway extending in flow communication with said flow pipe and said flow bore of said valve body when said body is at said opened position for flowing pressurized water from said flow bore to said flow pipe.

13. The ground hydrant of claim 12 wherein said valve body includes an inlet orifice and an outlet orifice defined at opposite ends of said right angle flow bore of said valve body, said inlet orifice of said valve body when at said opened position being aligned with said inlet end of said valve housing to permit communication of pressurized water from the supply thereof to said flow bore, said inlet orifice of said valve body when at said closed position being offset from said inlet end of said valve housing to block communication of pressurized water from the supply thereof to said flow bore.

14. The group hydrant of claim 10 wherein said rotation limiting means includes:

interengaging means defined on said spherical body of said control valve and said seat of said stopper member for limiting rotational movement of said valve body relative to said valve housing to between said opened and closed positions, said interengaging means including an elongated slot recessed in an exterior surface of said valve body adjacent to said stopper member and defined in an arc about said rotational axis of said valve body, said slot having stop surfaces defined at opposite ends of said slot, said interengaging means further including a stop pin attached to said stopper member and projecting into said slot, said stop pin being engageable with said respective slot end stop surfaces as said valve body is rotated to said respective opened and closed positions relative to said valve housing.

15. The ground hydrant of claim 10 wherein said support pipe is spaced sufficiently outwardly from said flow pipe to permit insertion of a heat conducting device between said flow pipe and said support pipe.

16. The ground hydrant of claim 10 further comprising:

an annular cap disposed in a sealing relation on an open end of said support pipe and having a central opening with said flow pipe extending therethrough in a sliding sealing relation with said cap while permitting rotational and axial movement of said flow pipe relative thereto.

17. A ground hydrant, comprising:

(a) an elongated hollow water flow pipe extending from above the ground to below the frost line in the ground, said flow pipe having upper and lower opposite ends and a longitudinal axis;

(b) an elongated support pipe disposed around said flow pipe, said support pipe having upper and lower opposite ends, said support pipe at said upper end thereof defining a sliding seal with said flow pipe;

(c) a flow control valve having a generally spherical body, a generally right angle flow bore defined through said body and having an inlet orifice and an outlet orifice, and a hollow extension tube having opposite ends, said extension tube being attached at one of said opposite ends to said body at said outlet orifice thereof in flow communication with said right angle flow bore, said extension tube projecting outwardly from said body;

(d) a valve housing for positionable below the frost line in the ground, said valve housing having an inlet end for connection with a source of supply of water and an outlet end rotatably mounting said extension tube, said support pipe at said lower end thereof being attached to said valve housing, said valve housing mounting said control valve for movement between an opened position in which said inlet orifice of said valve body flow bore is aligned with said housing inlet end to permit communication of water from the source of supply thereof to said flow bore and a closed position in which said inlet orifice of said valve body flow bore is offset from said housing inlet end to block communication of water from the source of supply thereof to said flow bore; and p1 (e) means for coupling said lower end of said flow pipe to the other of said opposite ends of said extension tube such that by turning said flow pipe said control valve can be moved between the opened and closed positions, said coupling means being operable to permit attaching and detaching of said flow pipe to and from said control valve extension tube when said control valve is at its closed position;

(f) said valve housing including a housing block having a pair of opposite circular-shaped axially-aligned openings and a cylindrical cavity extending through said housing block between opposite openings, said spherical body of said control valve being disposed in said cylindrical cavity of said housing block;

(g) said valve housing also including a circular-shaped stopper member extending into and attached within one of said opposite openings of said housing block so as to close said one opening and a circular-shaped inlet port member defining said inlet end of said valve housing and extending into and attached within the other of said opposite openings of said housing block so as to close said other opening, said stopper member and said inlet port member defining respective seats disposed within said cylindrical cavity in spaced apart facing relation to one another and sealingly engaging opposite sides of said spherical body of said control valve and disposing said spherical body in alignment with and for rotation between said opened and closed positions about an axis extending coaxial with said longitudinal axis of said flow pipe, said valve body and stopper member having interengaging means for limiting rotational movement of said valve body relative to said valve housing to between said opened and closed positions.

18. The ground hydrant of claim 17 further comprising:

an annular cap disposed in a sealing relation on an open end of said support pipe and having a central opening with said flow pipe extending therethrough in a sealing relation with said cap while permitting rotational and axial movement of said flow pipe relative thereto.

* * * * *